US008120443B2

(12) United States Patent
Ziaei

(10) Patent No.: US 8,120,443 B2
(45) Date of Patent: Feb. 21, 2012

(54) RADIOFREQUENCY OR HYPERFREQUENCY CIRCULATOR

(75) Inventor: Afshin Ziaei, Vanves (FR)

(73) Assignee: Thales (FR)

( * ) Notice: Subject to any disclaimer, the term of this patent is extended or adjusted under 35 U.S.C. 154(b) by 553 days.

(21) Appl. No.: 12/302,829

(22) PCT Filed: May 31, 2007

(86) PCT No.: PCT/EP2007/055355

§ 371 (c)(1),
(2), (4) Date: Nov. 28, 2008

(87) PCT Pub. No.: WO2007/138101

PCT Pub. Date: Dec. 6, 2007

(65) Prior Publication Data

US 2009/0237173 A1 Sep. 24, 2009

(30) Foreign Application Priority Data

May 31, 2006 (FR) ..... 06 04857

(51) Int. Cl.
*H01P 1/10* (2006.01)
*H01P 5/12* (2006.01)

(52) U.S. Cl. ..... 333/105; 333/262

(58) Field of Classification Search ..... 333/105, 333/262, 132, 133, 1.1; 455/78; 200/181
See application file for complete search history.

(56) References Cited

U.S. PATENT DOCUMENTS

| | | | | |
|---|---|---|---|---|
| 4,430,619 | A * | 2/1984 | Epsom et al. | 330/149 |
| 5,578,976 | A * | 11/1996 | Yao | 333/262 |
| 6,433,657 | B1 * | 8/2002 | Chen | 333/262 |
| 6,580,337 | B1 | 6/2003 | Valas | |
| 6,621,387 | B1 * | 9/2003 | Hopcroft | 333/262 |
| 6,972,650 | B2 * | 12/2005 | Ma | 335/78 |
| 7,042,397 | B2 | 5/2006 | Charrier et al. | |
| 7,212,789 | B2 * | 5/2007 | Kuffner | 455/83 |
| 7,230,513 | B2 * | 6/2007 | Chou | 333/262 |
| 7,297,571 | B2 | 11/2007 | Ziaei et al. | |
| 7,586,384 | B2 * | 9/2009 | Ranta | 333/17.3 |
| 7,586,387 | B2 * | 9/2009 | Van Delden | 333/101 |
| 7,786,820 | B2 * | 8/2010 | Hunt et al. | 333/24 C |
| 2002/0053954 | A1 | 5/2002 | Shamsaifar et al. | |
| 2003/0107137 | A1 | 6/2003 | Stierman et al. | |
| 2003/0132522 | A1 | 7/2003 | Alie et al. | |
| 2004/0127178 | A1 | 7/2004 | Kuffner | |
| 2006/0135084 | A1 * | 6/2006 | Lee | 455/78 |

FOREIGN PATENT DOCUMENTS

| | | | |
|---|---|---|---|
| WO | WO 03105174 | A1 * | 12/2003 |
| WO | 2004003005 | A1 | 4/2004 |

* cited by examiner

*Primary Examiner* — Robert Pascal
*Assistant Examiner* — Alan Wong
(74) *Attorney, Agent, or Firm* — Lowe Hauptman Ham & Berner, LLP

(57) ABSTRACT

A circulator with at least three ports (p1, p2, p3) comprises two identical electromechanical micro-switches of the series type (MEMS1, MEMS2) formed on the same substrate, a first micro-switch being disposed in order to allow the transmission of a radiofrequency or microwave signal from an input port (p1) to a port (p2) designed to be connected to an antenna, a second micro-switch being disposed in order to allow the signal transmission between the port (p2) designed to be connected to an antenna and said output port. Application to a radiofrequency or microwave telecommunications system.

16 Claims, 10 Drawing Sheets

RADIOFREQUENCY OR HYPERFREQUENCY CIRCULATOR

CROSS-REFERENCE TO RELATED APPLICATIONS

The present Application is based on International Application No. PCT/EP2007/055355, filed on May 31, 2007, which in turn corresponds to French Application No. 0604857 filed on May 31, 2006, and priority is hereby claimed under 35 USC §119 based on these applications. Each of these applications are hereby incorporated by reference in their entirety into the present application.

FIELD OF THE INVENTION

The field of the invention is that of radiofrequency RF circulators and of their applications in radiofrequency or microwave telecommunications systems such as radar or wireless telephony systems.

An RF circulator is a device with n ports, allowing an RF signal to flow in only one direction. A circulator with three ports p1, p2, p3 is considered. A signal injected into a port p1 is transmitted to the port p2 and isolated from the port p3, whereas a signal input via the port p2 is transmitted to the port p3 and isolated from the port p1. There is thus a decoupling of the signals transmitted and received. A corresponding symbolic illustration of such a circulator whose port p2 is connected to an antenna is given in FIGS. 1*a* and 1*b*. If the circulator C receives a radiofrequency signal on the port p1 matched in impedance, there will be a path with low insertion loss in the clockwise direction and high losses will be observed in the opposite direction. The power will therefore be directed virtually without loss toward the port p2 and radiated by the antenna. The same thing applies from the port p2 to the port p3, and from the port p3 to the port p1. The essential properties of the circulator are thus to transmit, without losses, in a given direction and to attenuate the reflected waves very significantly.

BACKGROUND OF THE INVENTION

Circulators are notably used in telecommunications or radar systems, according to the principle illustrated in FIG. 2. A telecommunications system mainly comprises a central signal processing part notably providing an attenuation function AT and a phase-shifting function D, typically implemented by digital electronic circuits (microchips), associated with a transmitter stage E, a receiver stage R and an antenna A.

The transmitter stage E mainly comprises an amplifier DRA (for "Digital Research Amplifier"), an amplifier HPA (for "High Power Amplifier"), and an isolator I. An isolator is a particular case of a circulator. A 50 ohms load is connected to one of the ports (often the port 3 by convention). Whatever the impedance of the circuit connected at the output on the second port p2, there is practically no return toward the transmitter (port p1): the major part of the returned or coupled power is dissipated by the load connected to p3. An isolator is generally used in order to limit as much as possible signal returns onto the output of the HPA. The reason for this is that any signal arriving on the output of the HPA could lead to a serious malfunctioning or even the destruction of this component.

The receiver stage R comprises a bandwidth limiter circuit LIM and a signal amplifier generally denoted LNA (Low Noise Amplifier).

A circulator C with three channels (or ports) p1, p2, p3 controlled by an electronic activation circuit, not shown, allows a radiofrequency signal supplied by the transmitter stage to be transferred to the antenna A (transmission p1 toward p2, p3 being isolated), or a signal picked up by the antenna to be transmitted to the receiver stage (transmission p2 toward p3, p1 being isolated).

The radiofrequency circulator C must notably meet the following constraints in its characteristics: have fast switching times; withstand the high radiofrequency power of the signals to be transmitted to the antenna; have limited insertion losses.

According to the prior art, the radiofrequency circulators used are bulky structures using a ferrite and a permanent magnet that impose a direction of electromagnetic gyration.

However, these ferromagnetic circulators have various drawbacks. They are very costly components. They are not easily reproducible, since they require human intervention for correct adjustment. Their structure is very bulky. They occupy around 80% of the space within a telecommunications system. They consume a large amount of electrical power, and consequently pose problems of thermal dissipation. They introduce insertion losses (radiofrequency power losses in the coupling across the ferrite) of the order of 2 to 4 dB within their operating frequency band, which furthermore is narrow, of the order of 0.2 to 1 GigaHertz.

For all these various reasons, it is desirable to replace these ferromagnetic circulators by components which do not exhibit these various drawbacks.

SUMMARY OF THE INVENTION

The invention provides an alternative solution allowing the design of the circulators to be simplified, their production cost, the surface area occupied and the electrical power dissipated to be reduced.

One idea on which the invention is based is to use microelectromechanical devices (known by the acronym MEMS for Micro Electro Mechanical System) and, more particularly, micro-devices of the capacitor type, operating as switches, which micro-devices are referred to as micro-switches in the remainder of the description.

Micro-switches of the capacitor type are particularly appreciated in microwave applications, notably for their short response times in conjunction with relatively low control voltages ranging from a few volts to a few tens of volts. They are advantageously very small, of millimeter size (2 to 10 $mm^2$), being on average 10 times smaller than a ferromagnetic circulator. They exhibit a very low power consumption. They are very inexpensive to produce since they use fabrication techniques habitually used in microelectronics, starting from a substrate generally made of silicon, and are very easily reproducible. Their insertion losses are very low, generally in the range 0.1 to 0.2 dB over a very wide band of frequencies, 18 to 19 GigaHertz.

The invention is more particularly concerned with micro-switches of the series type: an input signal line and an output signal line in the projected extension of one another, separated by a switching region, and electrically isolated and, above the switching region, a flexible membrane, resting on pillars. The switching region is covered by a dielectric. The membrane is either in the idle, high, position, the capacitance formed by the switching region, the dielectric and the membrane having a low value Coff, in such a manner that the two signal lines are electrically isolated, or in the low position such that the two portions of line are coupled capacitively, the capacitance formed by the switching region, the dielectric and the membrane having a high value Con, allowing the transmission of a radiofrequency or microwave signal. The control of the membrane is a voltage control applied in an appropriate manner in the switching region, the membrane being held at a reference potential (electrical ground) by the pillars. The switching performance (transmission, isolation) notably depends on the ratio of Con to Coff which must be as high as possible.

One idea on which the invention is based is to take advantage of all the properties of such a micro-switch component of the series type in order to produce a circulator adapted to radiofrequency telecommunications systems.

The subject of the invention is therefore a circulator with at least three ports, a first input port for receiving a radiofrequency or microwave signal to be transmitted to a second port designed to be connected to a transmitting/receiving antenna, a third output port able to be connected to a device for receiving a radiofrequency or microwave signal. The system is characterized in that it comprises two identical electromechanical micro-switches of the series type according to the invention, formed on the same substrate, a first micro-switch being disposed in order to allow the transmission of a radiofrequency or microwave signal from said input port to the port designed to be connected to an antenna, a second micro-switch being disposed in order to allow the signal transmission between said second port and said output port, and in that it is associated with an impedance matching circuit connected between the second port and the antenna, said circuit having the function of acting as a virtual obstacle to the transmission of a radiofrequency or microwave signal from said second port to the first port.

More precisely, the circulator has at least three ports, an input port for receiving a radiofrequency signal to be transmitted to a port designed to be connected to a transmitting/receiving antenna, an output port able to be connected to a receiving device or a load. It comprises two identical electromechanical micro-switches of the series type formed on the same substrate. A first micro-switch is disposed in order to allow the transmission of a radiofrequency or microwave signal from said input port corresponding to the first signal line of said first micro-switch to the port designed to be connected to an antenna, corresponding to the second signal line of said first micro-switch. A second micro-switch is disposed in order to allow the signal transmission between the port designed to be connected to an antenna, corresponding to the first signal line of said second micro-switch, and said output port corresponding to the second signal line of said second micro-switch.

The circulator comprises at least a first and a second bump contact for applying control voltages at the on or off state to at least one of the parts of the control electrode of the first micro-switch and of the second micro-switch. The activation voltages are of the order of one volt to a few tens of volts. The micro-switches can be simultaneously commanded to turn off, or one to turn on and the other to turn off.

According to one aspect of the invention, the structure of the micro-switches of such a circulator must be very well matched in impedance for the transmission of radiofrequency power to be significant. Notably, a micro-switch structure or topology is sought that is able to handle the high radiofrequency power to be transmitted to the antenna (in transmission mode), with good radiofrequency and microwave transmission and isolation properties—low insertion losses, a low latency (characteristic switching time at the off and at the on state), while maintaining low levels of control voltage of the order of a few volts to a few tens of volts.

A topology is needed that allows the radiofrequency capacity in the on state of the switch to be enhanced, a low capacity to be presented in the off state and invariant with frequency in order to optimize its electromechanical performance and to guarantee a lifetime of the micro-switch in terms of number of switching operations equal to at least $10^{11}$.

According to the invention, each micro-switch of the circulator is formed on a base substrate coated with a passivation layer, and is characterized in that it comprises:

- a mobile metal membrane forming a bridge over a switching region between a first signal line and a second signal line isolated from one another. The first and second signal lines are disposed within the projected extension of one another and said membrane comprises at least one layer of a metal selected from Al, Au or Cu,
- a voltage control electrode formed from a resistive conducting material on the passivation layer, within said switching region, and comprising two electrically isolated parts, one in contact with the first signal line and the other in contact with the second signal line,
- a dielectric material of high relative permittivity greater than one hundred, and invariant with frequency, disposed on said control electrode, and having a shape such that in the direction of the two signal lines, said control electrode is wider on either side, and in the orthogonal direction, the dielectric material protrudes on either side from said control electrode, and comes into contact with said passivation layer.

The membrane rests at one end, at least, on a conducting pillar, said conducting pillar and the signal lines being formed on said passivation layer.

In one embodiment, the circulator comprises two parallel coplanar ground lines, disposed symmetrically with respect to said first and second signal lines, said ground lines being separated from said signal lines by an insulating layer formed from a material different from that of the first passivation layer of the substrate.

The impedance matching circuit is advantageously formed by two micro-switches of the series type formed on the same substrate, used as variable capacitors, each being disposed between two sections of a signal line which is designed to be connected at one end to the port of the circulator designed to receive the antenna, and at another end, to be connected to the antenna, the capacitance of each micro-switch being defined by the voltage applied to a respective control electrode and the geometric characteristics of the membrane, the inductance of each cell being defined by the geometric dimensions of a corresponding section of signal line.

Another subject of the invention is a radiofrequency telecommunications system comprising a transmitting/receiving antenna, a transmission circuit with amplifier, a receiver circuit with amplifier and a first circulator according to the invention with a first port connected to the output of the transmission circuit, a second port connected to the antenna, a third port connected to the receiver circuit.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

FIGS. 10*a* and 10*b* to 16*a* and 16*b*, 17, 18*a*,18*b* and 19 illustrate topological phases of a fabrication process for a micro-switch such as is illustrated in FIGS. 4*a* to 4*c*.

DETAILED DESCRIPTION OF THE INVENTION

Figure 1A:
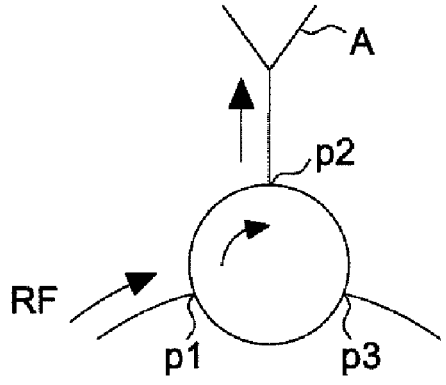
FIGS. 1*a* and 1*b* illustrate two modes of signal transmission in a circulator.
Figure 1B:
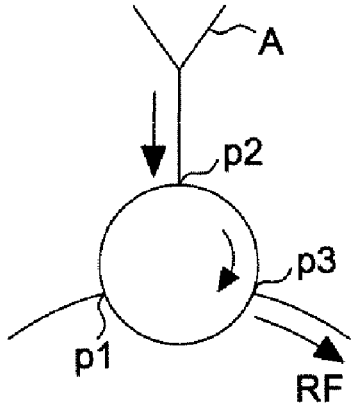
Figure 2:
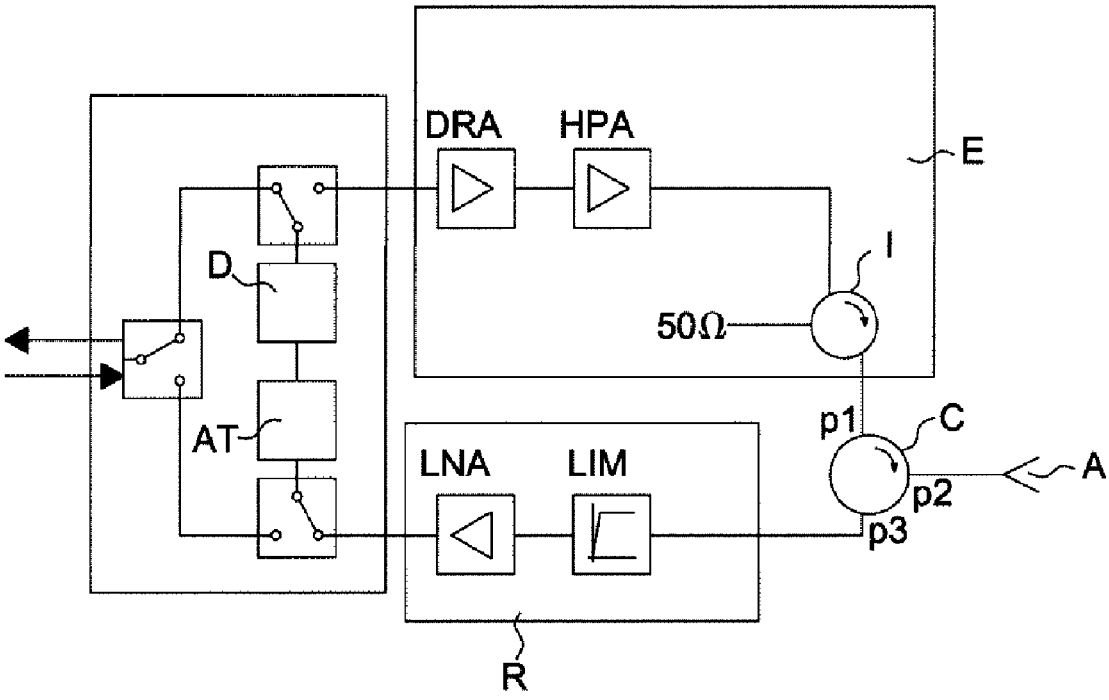
FIG. 2 is a simplified diagram of a wireless telecommunications system comprising a circulator according to the prior art.
Figure 3:
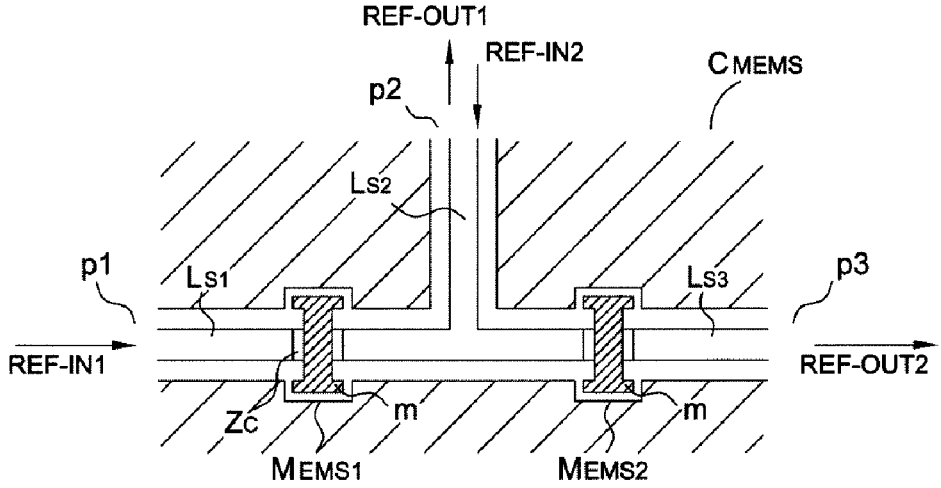
FIG. 3 illustrates schematically a top view of a circulator using micro-switches according to the invention.

A circulator CMEMS according to the invention is described with reference to FIGS. 3 to 9. As illustrated in FIG. 3, the circulator CMEMS comprises two identical micro-switches of the series type. A first micro-switch MEMS1 is disposed in order to allow the transmission of a radiofrequency or microwave signal from an input port p1 via a signal line Ls1 to a port p2 designed to be connected to an antenna, via a second signal line Ls2. A second micro-switch MEMS2 is disposed in order to allow the signal transmission from the second port p2, via the signal line Ls2 to an output port p3, via a third signal line Ls3.

The entire circulator, notably with the micro-switches and the signal lines, is formed on the same base substrate.

Generally speaking, each micro-switch of the series type comprises an assembly membrane—dielectric material—control electrode that forms a variable capacitor for which the membrane and the electrode form the plates. The control electrode is disposed within a switching region between the two signal lines associated with the micro-switch and takes the form of two isolated parts, preferably interdigitated, each part contacting a signal line. It is covered by a dielectric. The membrane is disposed on top of the switching region. The dielectric is chosen so as to exhibit a high relative permittivity, higher than one hundred. It is preferably PZT, whose relative permittivity, determined during the fabrication of the PZT so as to be equal to 150 in the case of interest here, is advantageously invariant with frequency.

A capacitor is thus formed whose plates are, on the one hand, the membrane and, on the other hand, the facing control electrode. The capacitance of the capacitor thus formed varies between a low value Coff corresponding to an off (open) state of the micro-switch and a high value Con corresponding to an on (closed) state of the micro-switch. When the control electrode does not generate any voltage under the membrane, the latter is at rest, in the high position. The capacitance Coff of the capacitor is low and of the order of ten femtofarads. This very low capacitance results in a sufficiently high impedance between the two conducting lines so that no signal is able to pass from one line to the other. The micro-switch is open.

When the membrane—electrode assembly is subjected to an activation voltage, for example of around 32 volts, the membrane is subjected to an electrostatic force that deforms it until it comes into contact with the dielectric on the control electrode. The capacitance Con of the capacitor increases by a ratio of about one hundred. This capacitance Con, of the order of a picofarad, results in an impedance between the two signal lines that is sufficiently low for the radiofrequency or microwave signal to be able to pass between the two lines. The micro-switch is closed.

Figure 4A:
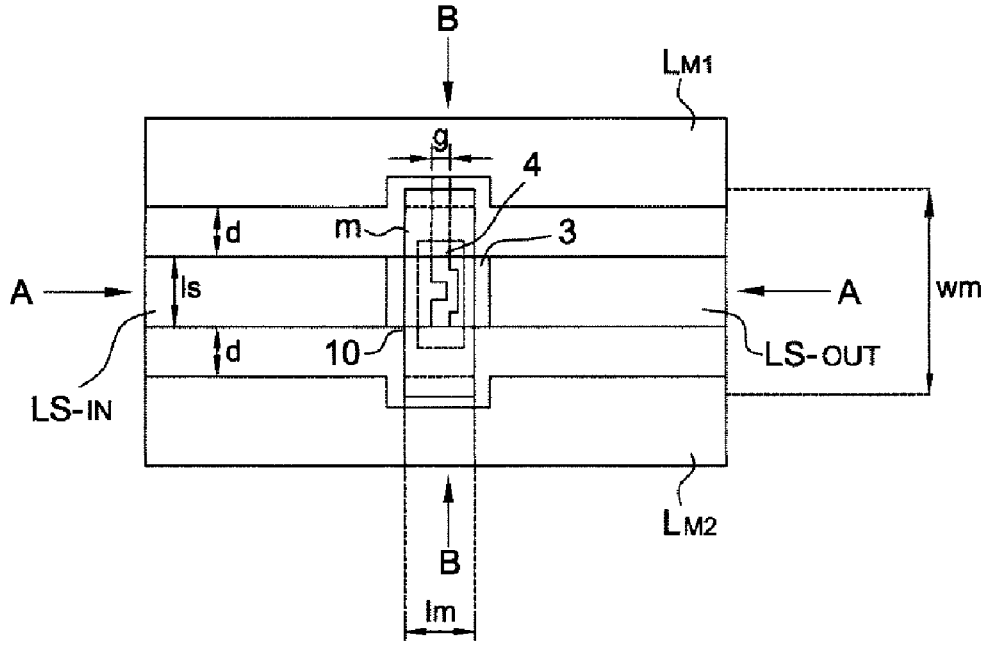
FIGS. 4*a* to 4*c* illustrate a top view and a cross sectional view of the structure of a series micro-switch according to the invention, specially designed for a circulator according to the invention.
Figure 4B:
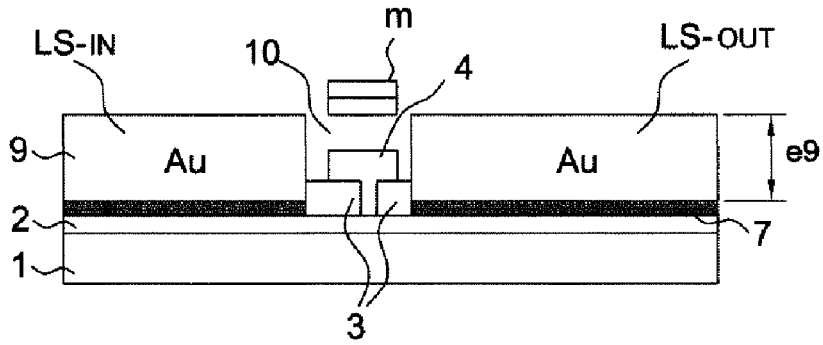
Figure 4C:
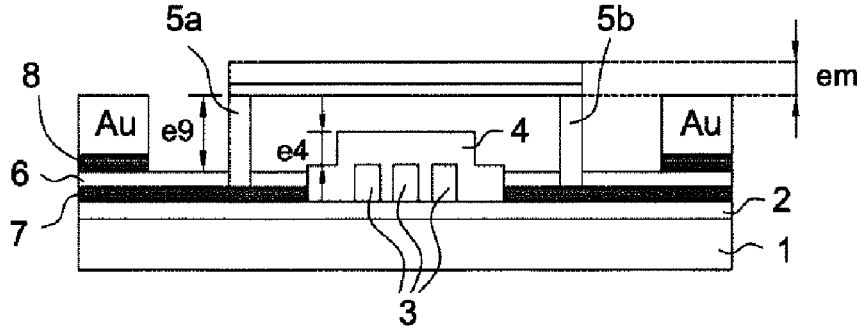

Advantageously, the structure of each micro-switch MEMS1, MEMS2 of a circulator CMEMS according to the invention is as illustrated in FIGS. 4*a*, 4*b* and 4*c*, respectively showing a top view, a cross section through AA and through BB.

This structure is formed by superposition of layers on a base substrate 1, typically a highly-resistive silicon substrate, coated with a passivation layer 2, typically of silicon dioxide $SiO_2$.

It comprises two signal lines LS-IN and LS-OUT formed on the passivation layer 2, disposed in a coplanar manner within the projected extension of one another, separated by a switching region 10. Within the switching region, a control electrode 3 is formed between the two signal lines, in two electrically isolated parts: each part is in contact with a signal line. A dielectric 4 with high relative permittivity, greater than one hundred, and invariant with frequency is deposited on the control electrode 3. It has a shape such that, in the direction of the signal lines, the control electrode is wider on either side, and in the orthogonal direction, it protrudes on either side of the control electrode 3, over the passivation layer 2.

The dielectric 4 must meet the constraints of high radiofrequency or microwave power: in transmission in the on (conducting) state (membrane in the position bent downward, in contact with the dielectric), and in the isolated off or open state (membrane in the initial high position).

The dielectric 4 is preferably PZT, which combines the advantages of having a high relative permittivity greater than one hundred and invariant with frequency, of being able to operate at microwave frequencies, up to 100 GigaHertz, and of handling the power levels, owing to its single-crystal nature. Preferably, a PZT is used with a relative permittivity equal to 150, determined during its fabrication.

In practice, the gap separating the two parts of the control electrode has a width g of around 10 microns. The break between the two parts can have a straight cross section. It is advantageously such that the two parts are interdigitated. In a known manner, such a shape allows the dielectric capacitance of the capacitor formed by the membrane m, the control electrode 3 and the dielectric 4 to be significantly increased.

Preferably, the control electrode is made from a platinum/gold alloy in order to satisfy technological requirements.

At each end, the membrane m rests on a conducting pillar 5*a*, 5*b*. It may also be envisioned that only one of the two conducting pillars supports the membrane.

In the example, the micro-switch structure is of the coplanar type: ground lines LM1 and LM2 are formed on the same face of the substrate as the signal lines LS-IN and LS-OUT. These coplanar ground lines are formed on a topological level separated from the level of the input/output signal lines by an insulating layer 6, made from a material different from that used for the passivation layer. This insulating material is typically silicon nitride. In this way, it is certain that a short-circuit will not occur between a signal line and a ground line, via the substrate. The technical effect of this is that the micro-switch structure according to the invention is able to go very high in frequency, typically up to at least 100 GigaHertz.

It will be noted that, if a microstrip technology (not shown) is considered, according to which the ground plane is formed on the back side of a substrate adapted to this technology, the insulating layer 6 no longer serves any purpose.

The pillars, the signal lines and the ground lines typically comprise a first adhesion layer, which is resistive, shown as a thick dark line in FIGS. 4*b* and 4*c*, and a second layer with low resistance, typically of gold. The first layer is sufficiently resistive to prevent the propagation of a radiofrequency or microwave signal. This is typically a layer of titanium-tungsten, preferably with 80% of titanium and 20% of tungsten to within 1 or 2%, using which the best radiofrequency and microwave performances are obtained.

The layer of titanium-tungsten 7 for the signal lines and for the pillars is also used for the fabrication of the connection lines via which an activation voltage for the micro-switch can be applied in the switching region. In practice, at least one bump contact (not shown in FIGS. 4*a* to 4*c*) is formed in the same way as the signal line and the pillars, on the same topological levels, and a connection line is formed between this bump contact and at least one signal line. Preferably, the bump contact is connected to both signal lines LS-IN and LS-OUT, such that the voltage appears on both parts of the control electrode 3. The disposition in the form of interdigitated fingers allows there to be a metal part substantially in the middle under the membrane. These two features combined allow a maximum electrostatic field to be obtained substantially in the middle of the membrane, which guarantees optimum on and off switching times.

The metal membrane comprises:

- a resistive adhesion layer, typically of titanium-tungsten, situated facing the switching region. This layer is sufficiently resistive to prevent the propagation of a radiofrequency or microwave signal. The titanium-tungsten preferably has a proportion of 80% of titanium and 20% of tungsten to within 1 or 2%, as previously indicated.
- a highly-conducting layer, made from a material selected from Al, Cu and Au. These metals are selected for their low electrical resistivity and their capacity to handle mechanical stresses greater than 30 megapascals: the membrane must be capable of deforming in order to come into contact with the dielectric 4 without breaking (on state), and of returning to its initial state (off state). Preferably, aluminum is used, with which the best results are obtained in terms of switching speed and tolerance to mechanical stress.

In one preferred embodiment of a micro-switch, the following design characteristic dimensions are chosen:

The cross section of the signal lines has a width Is of 80 microns, and the distance d separating on either side the signal line from the ground line is equal to 120 microns.

The layer of gold e9 for the signal lines and for the pillars has a thickness of around 3 microns. The control electrode has a thickness of around 0.7 microns. The thickness of the ground lines is not an important parameter. The layer 4 of PZT has a thickness e4 of less than a micron, for example 0.4 micron. The thickness of the ground lines depends on the technological process used.

The mobile part of the membrane, in other words apart from the pillars, takes the form of a rectangular parallelepiped, whose dimensions are advantageously: a width Im of 100 microns, in the direction of the signal lines, and a length wm between the two pillars of around 280 microns. The total thickness em of the membrane is around 0.7 microns, the first layer of titanium-tungsten having a thickness less than the second layer. In one example, the layer of titanium-tungsten has a thickness of 0.2 microns. The dielectric PZT protrudes along a length of around 20 microns over the passivation layer, on either side.

The micro-switch that has just been described has excellent radiofrequency and microwave performances, notably for the transmission of signals with significant radiofrequency or microwave power of the order of about ten watts.

Figure 10A:
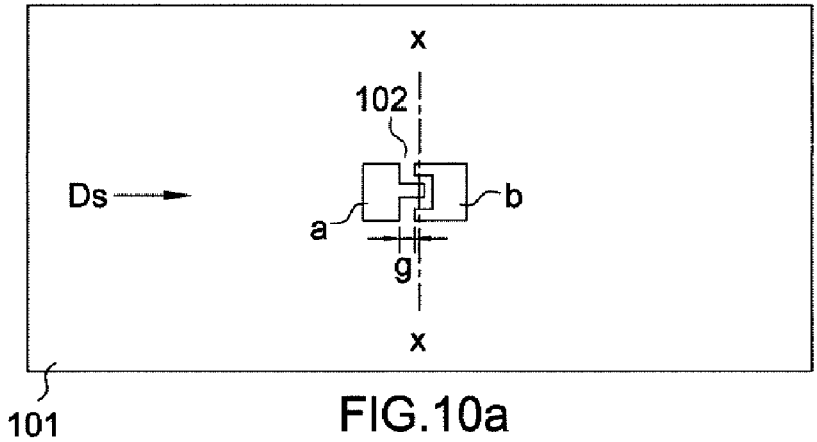
Figure 10B:
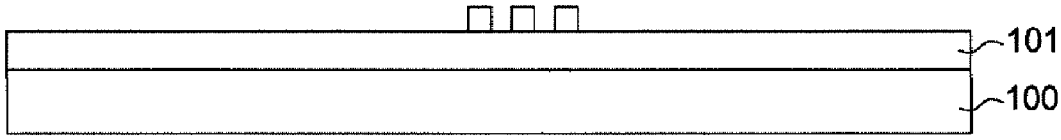

One example of a process for fabrication of such a micro-switch is given at the end of the present description, with reference to FIG. 10*a* and the following figures, for a coplanar technology.

Figure 5A:
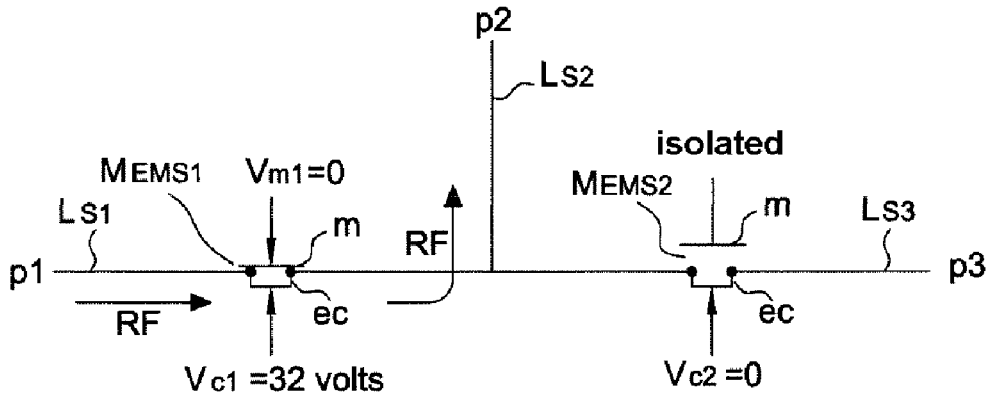
FIGS. 5*a* and 5*b* illustrate the radiofrequency signal transmission modes in the circulator according to the invention, with corresponding activation voltages indicated by way of example.

In practice, the voltage control of the switching of the micro-switches, according to whether the system operates in transmission or receiver mode, is provided by an electronic circuit whose operation is comparable with that of ferromagnetic circulators, with the difference of the voltage levels to be applied, which are lower. FIG. 5*a* is a simplified circuit diagram of the circulator, in a state corresponding to the transmission of a radiofrequency signal from the port p1 (RF input) to the port p2 (Antenna). The micro-switch MEMS1 must then be commanded to close (Con), and the micro-switch MEMS2 must then be commanded to open (Coff). This is obtained as illustrated in FIG. 5*a*, by applying to each micro-switch a reference voltage (electrical ground) to the membrane m and an appropriate activation voltage to the control electrode ec. In one example, there are thus the voltages Vm1=0 volt (electrical ground), Vc1=32 volts (activation voltage for the on state) respectively applied to the membrane m and to the control electrode ec of the first micro-switch MEMS1 commanded to turn on. The membrane m of the second micro-switch MEMS2 is isolated (no applied voltage) and the voltage Vc2 applied to the control electrode ec is equal to 0 volts.

Figure 5B:
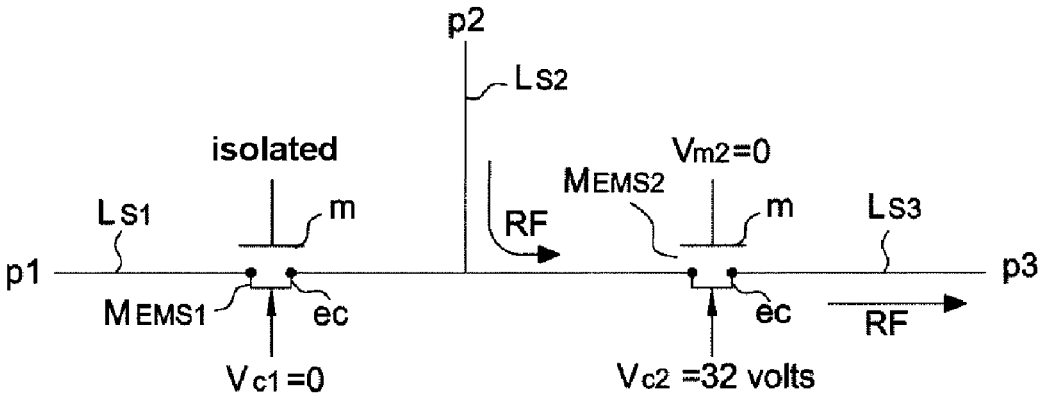

For the transmission of a radiofrequency signal from the port p2 (Antenna) to the port p3 (RF output), the situation is reversed, as illustrated in FIG. 5*b*: the micro-switch MEMS1 must then be commanded to open (Coff), and the micro-switch MEMS2 must then be commanded to close (Con).

A circulator according to the invention exhibits excellent performance characteristics, notably in terms of insertion losses, of the order of a tenth of a dB to a few tenths of a dB, and a very significant gain in space, with a component ten times smaller than the ferromagnetic circulators and a wider operating frequency band, over around 18 to 19 GigaHertz.

The circulator that has just been described with reference to FIG. 4 is a passive component. It is typically an SPDT (Single Pole, Double Throw) component, which has the drawback of allowing the passage of the radiofrequency signal in both directions: the signal transmission between the ports p1 and p2 and between the ports p2 and p3 can potentially operate in both directions, the micro-switches not seeing the difference. Typically, with such a passive circulator, part of the radiofrequency power picked up by the antenna may be reflected toward the transmitter port p1.

Figure 6:
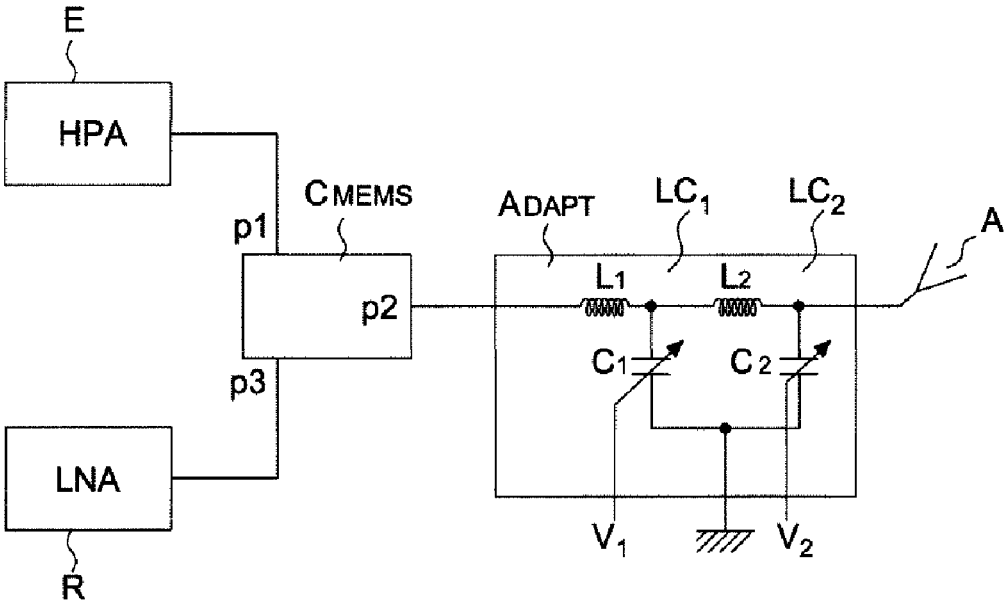
FIGS. 6 and 7 illustrate a matching circuit using capacitors according to the invention.

According to the invention, and as illustrated in FIG. 6, an impedance matching circuit ADAPT with two cells of the LC type, denoted $LC_1$ and $LC_2$, is advantageously provided. It is connected between the antenna A and the port p2 to which the antenna A is to be connected. Such an impedance matching circuit acts as a virtual obstacle with regard to the input port p1, which then sees an infinite impedance.

Figure 7:
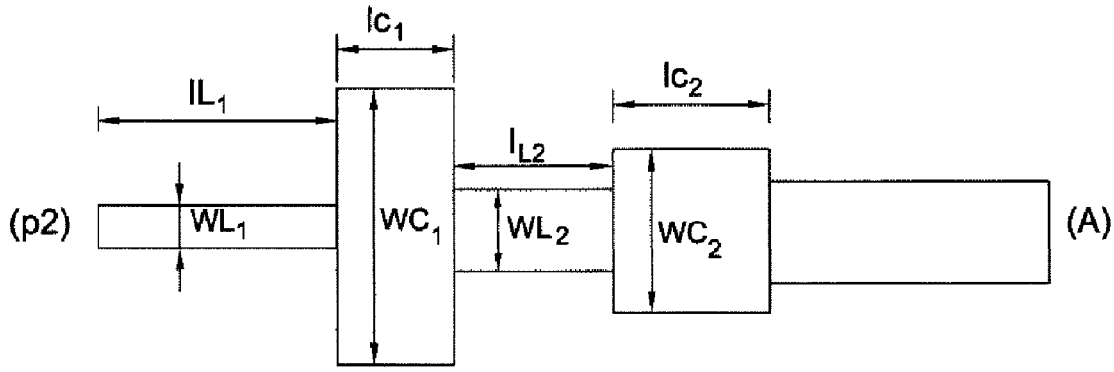

Reference is made to FIG. 7. The impedance presented by the antenna to the output p2 of the circulator of the system is denoted Zrc. The impedance presented by the circulator to the input of the antenna is denoted Zrs.

A first cell $LC_1$, comprising an inductor $L_1$ and a capacitor $C_1$ and a second cell $LC_2$ comprising an inductor $L_2$ and a capacitor $C_2$ are connected in series between the output p2 of the circulator and the antenna A: the inductors $L_1$ and $L_2$ are connected in series between p2 and A. The capacitor $C_1$ is connected between the mid-point between the two inductors and ground. The capacitor $C_2$ is connected between the point of connection between the inductor $L_2$ and the antenna A and to ground.

In order not to have any reflection at the output p2 of the circulator, a value equal to 50 ohms is sought for Zrc and a value Z, which is a characteristic of the antenna, is sought for Zrs, the impedance presented by the system to the input of the antenna. The circuit ADAPT is thus a two-pole filter.

By means of a judicious choice of the inductors L1 and L2, together with that of the capacitors C1 and C2, according to the prior art, matching over a frequency band corresponding to the transmission and reception band of the antenna is achieved.

In a first embodiment of the invention (FIG. 6), this impedance matching circuit is a passive filter: the elements of the cells $LC_1$ and $LC_2$ are pre-configured (or dimensioned) for a given application, in other words for a given antenna: frequency, antenna impedance.

One preferred embodiment of such an impedance matching circuit is based on micro-switches comparable to those employed for the circulator, with the difference that the membrane is formed from a single thick layer of aluminum, so as to form a rigid structure, whose displacement can be controlled in stages, according to the amplitude of the activation voltage applied to the control voltage. This voltage then defines the displacement of the rigid membrane, in the range between the rest position and a maximum, pre-defined, position. Preferably, the membrane has a thickness of around 2.5 microns. Notably, the micro-switches have the same structure as that described with reference to FIGS. 4*a* to 4*c*, with the exception of the structure of the membrane as indicated above.

The inductors are then formed by the portions of signal line between the micro-switches, as illustrated in FIG. 7. The inductance and capacitance parameters of each cell are defined by the geometry of the membranes (width $Ic_1$, $Ic_2$, length $wc_1$, $wc_2$) and of the signal lines $L_1$ and $L_2$, of width $IL_1$, $IL_2$, and length $wL_1$, $wL_2$, and by the activation voltages applied to the control electrodes. These activation voltages define the height of the displacement of the membrane and, consequently, the value of the capacitance.

As illustrated in FIG. 6, the value of the capacitance is then defined, for a given set of dimensions, by the value of the activation voltage applied to each control electrode: V1 for the first capacitor C1 and V2 for the second capacitor C2. It is the voltages that determine the position of the membrane in each micro-system, in operational mode, for a given application.

In FIG. 7, the diagram shown corresponds to a circuit structure of the microstrip type: the substrate adapted to this technology is equipped with a ground plane on its back side.

Those skilled in the art are able to fabricate such a circuit in a similar manner using coplanar technology: coplanar ground lines are then formed symmetrically disposed on either side of the signal lines, laying out the shape of the signal lines and of the membranes in such a manner as to be everywhere separated by a given break value, typically of 80 microns.

According to one improvement of the invention, the impedance matching circuit is active, allowing dynamic impedance matching. It comprises variable capacitors which allow its filtering characteristics to be dynamically matched with the variation in impedance seen at the output. This then provides a device particularly well adapted for use with antennas known as active antennas, or with reconfigurable antenna arrays used in some systems, for example in radar systems.

Figure 8:
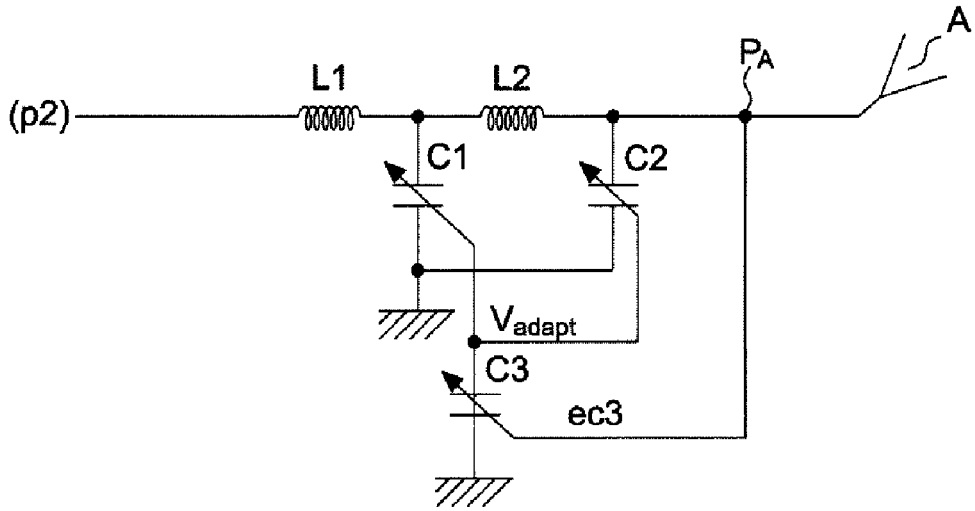
FIG. 8 is a simplified diagram of a dynamic impedance matching circuit with micro-switches according to the invention.

One preferred embodiment of such a dynamic impedance matching circuit is based on the embodiment described with reference to FIG. 6, with a difference for the activation voltage of the control electrodes. This embodiment is illustrated in FIG. 8. Indeed, another micro-switch is used as variable capacitor C3, in order to control the voltage Vadapt applied to the control electrodes of the variable capacitors C1 and C2, the control electrode ec3 of this variable capacitor C3 being connected to the bump contact $P_A$ designed to be connected to the antenna A. Indeed, the current or the voltage at this point depends on the real impedance of the antenna. An impedance matching circuit that is auto-matching to the variation in impedance presented by the antenna is thus advantageously obtained, which is particularly relevant to active antenna or antenna array systems. It may be fabricated using microstrip or coplanar technology.

The elements of the LC cells are then dimensioned (inductance, capacitance) in order to respond to a given frequency band, corresponding to a frequency band where the voltage control according to the invention enables dynamic auto-matching in operational mode.

Preferably, the impedance matching circuit ADAPT is fabricated separately from the circulator. The circuit and the circulator may thus be adapted according to the telecommunications system in question and to the characteristics of the antenna.

Figure 9:
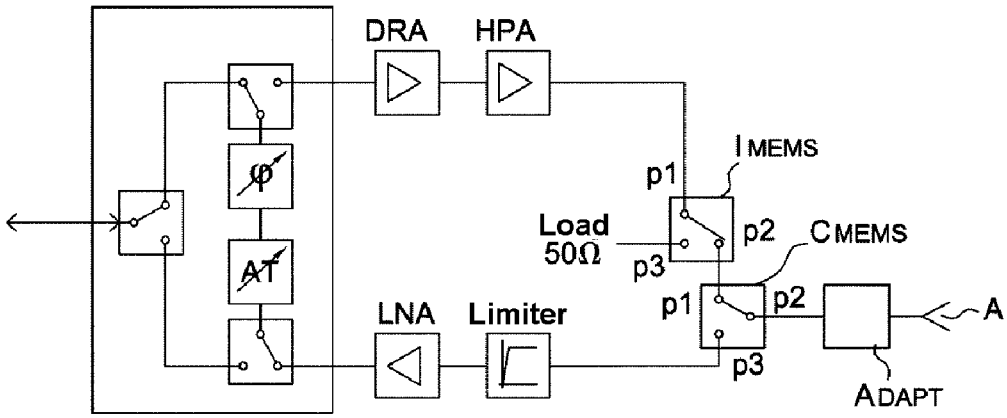
FIG. 9 is a simplified diagram of a wireless telecommunications system according to the invention.

FIG. 9 illustrates the configuration of a telecommunications system that may be constructed according to the invention, with an isolator IMEMS, a circulator CMEMS and an impedance matching circuit ADAPT connected between the port p2 and an antenna A. The isolator IMEMS is placed between the transmitter E, at its input port p1, and the input port of the circulator, connected to its port p2, with a 50 ohm load connected to the port p3.

A fabrication process for a micro-switch advantageously used in the invention, such as is described with reference to FIGS. 3*a* to 3*c*, will now be described. It is illustrated by FIG. 10*a* and the following figures, which show the various characteristic steps 1 to 10 of the process.

Step 1, FIGS. 10*a* (top view) and 10*b* (cross section along X). On a substrate 100, for example made of high-resistance silicon, a passivation layer 101 of silicon dioxide $SiO_2$ (relative permittivity 4) is formed. The control electrode 102 is formed with the shape in two isolated parts a, b, preferably interdigitated as illustrated. The width g of the gap between the two parts is typically 10 microns. The control electrode is for example formed from a titanium/platinum alloy onto which a gold/platinum layer is deposited.

Figure 11A:
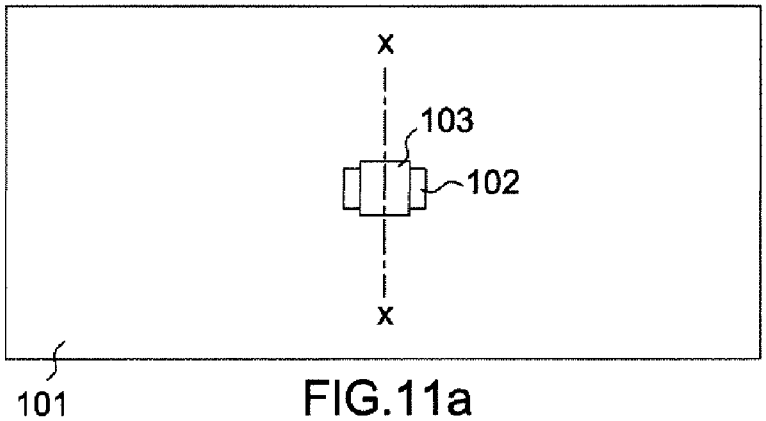
Figure 11B:
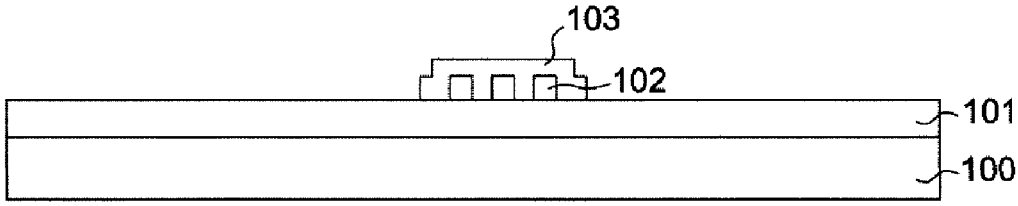

Step 2, FIGS. 11*a* and 11*b*. The dielectric PZT 103 is formed on the control electrode according to the prescribed shape, typically by a process of the sol-gel type or by sputtering: narrower in the direction Ds of the signal lines and wider on either side in the orthogonal direction, lying on the passivation layer 101.

Figure 12A:
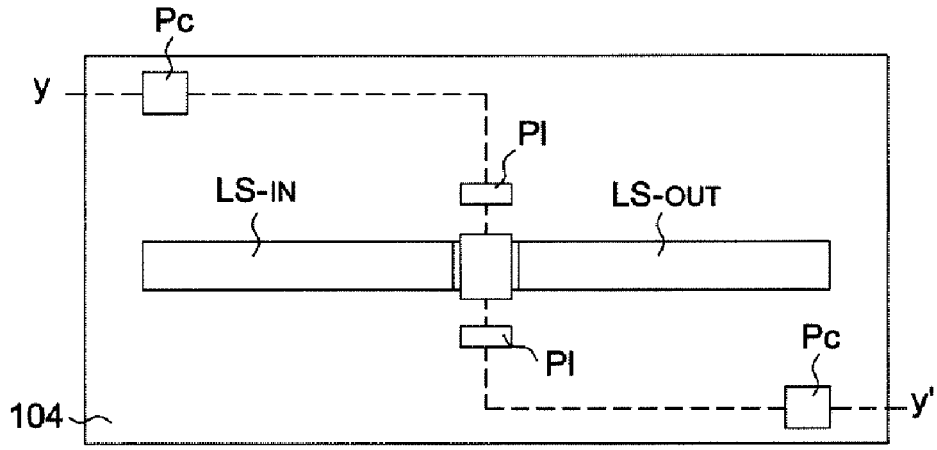
Figure 12B:
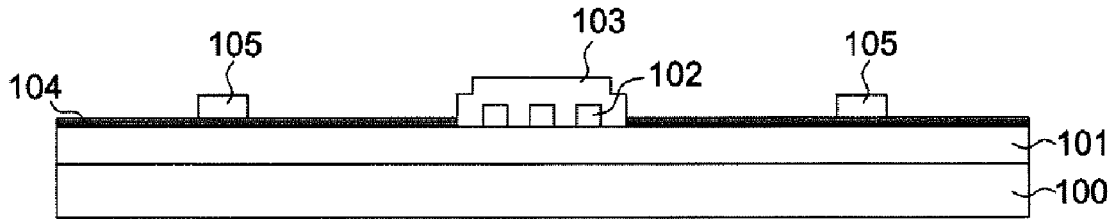

Step 3, FIGS. 12*a* (top view) and 12*b* (cross section along YY'). Formation of the signal lines LS-IN and LS-OUT, of the bump contacts Pc, and of the pillars Pl, by deposition of a layer of titanium/tungsten 104, deposition and etch of a layer of gold 105. The surface layer is then the layer 104.

Figure 13A:
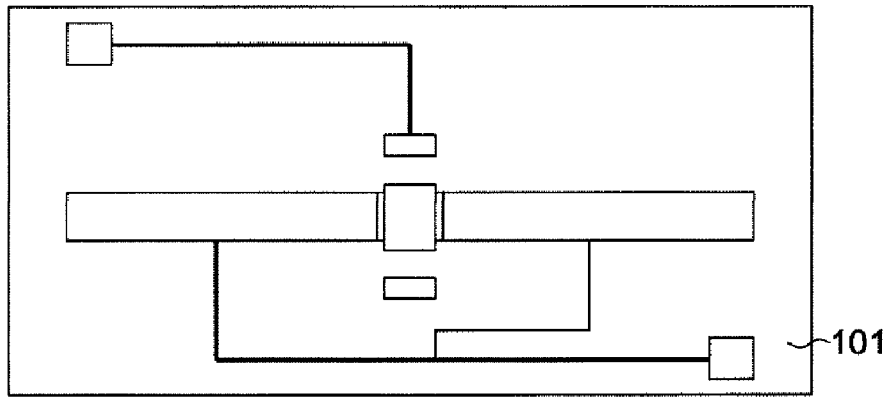
Figure 13B:
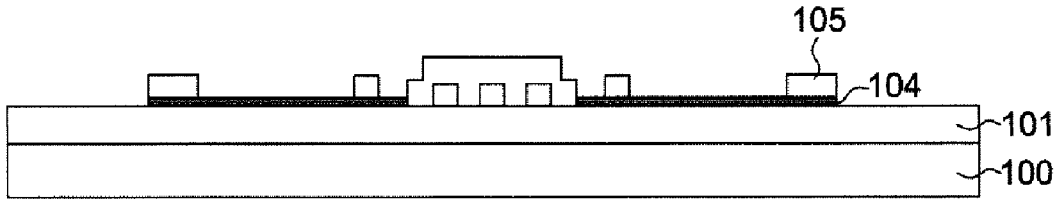

Step 4, FIGS. 13*a* and 13*b*: etch of the layer 104 of titanium/tungsten, in order to form connection lines between a bump contact and one or both of the two signal lines (in order to apply an activation voltage to one or both of the two parts of the control electrode), and a bump contact and a pillar in order to bias the membrane at a reference of voltage (electrical ground). The remainder of the surface layer, outside of the fabricated elements, is the passivation layer 101.

Figure 14A:
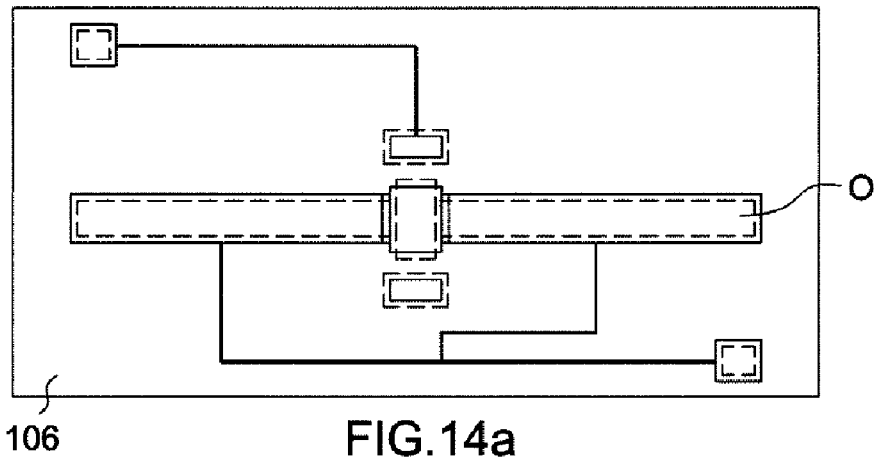
Figure 14B:
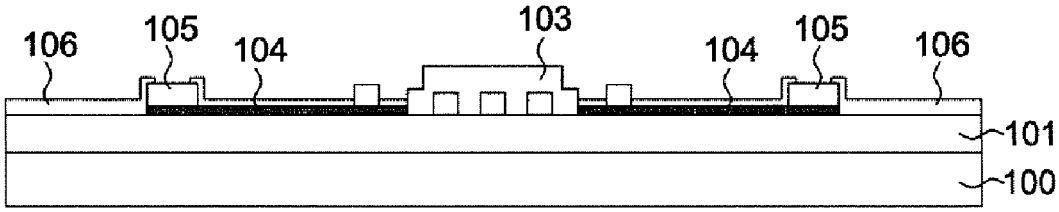

Step 5, FIGS. 14*a* and 14*b*. Deposition of the insulating layer of silicon nitride $Si_3N_4$, then opening O onto the signal lines, the bump contacts, the pillars and the dielectric 103, indicated by the dashed lines. The surface layer is this insulating layer 106.

Figure 15A:
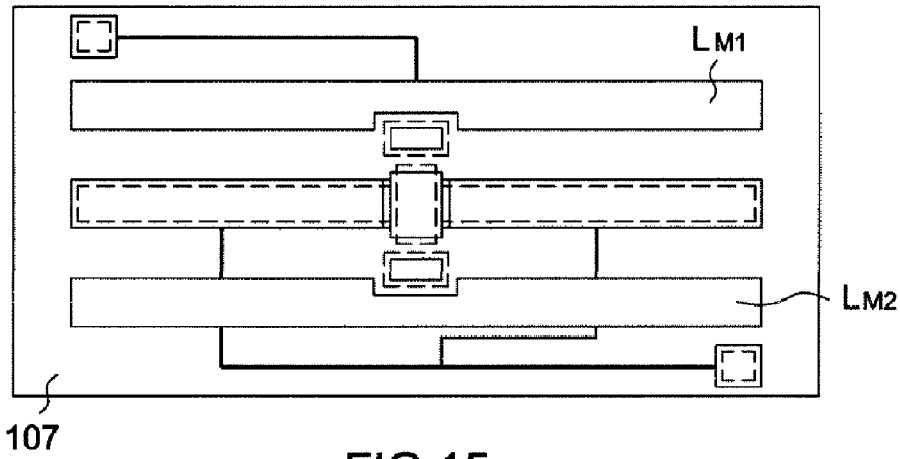
Figure 15B:
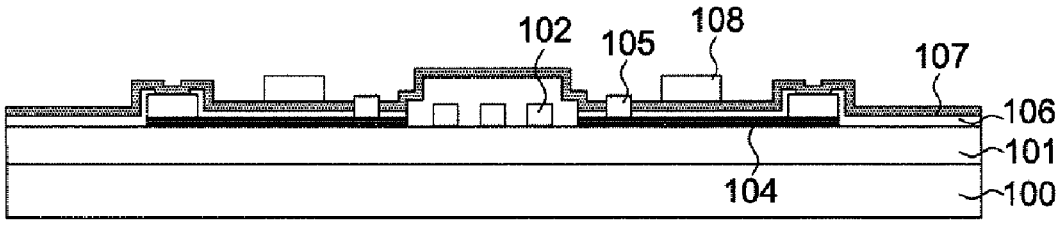

Step 6, FIGS. 15*a* and 15*b*. Deposition of a layer 107 of titanium/tungsten and deposition and etch of a layer of gold 109, in order to form the ground lines LM1 and LM2. The surface layer is the layer 107 of titanium/tungsten.

Figure 16A:
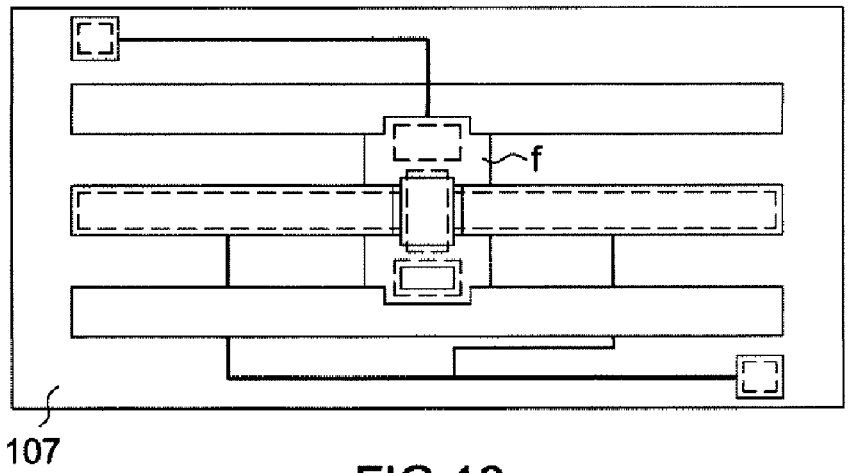
Figure 16B:
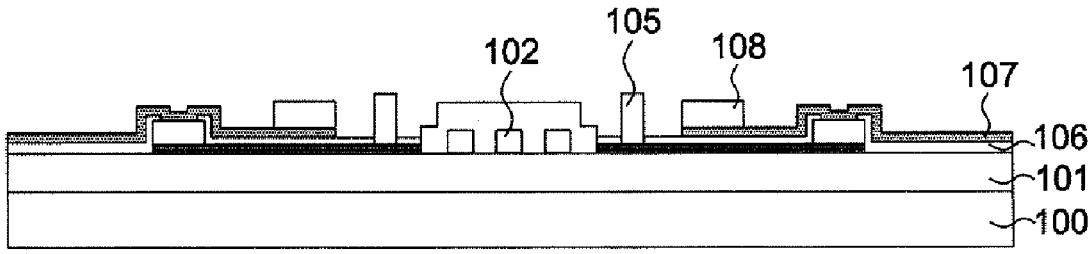

Step 7, FIGS. 16*a* and 16*b*. Localized etch-back of titanium-tungsten within a region f under the location of the membrane.

Figure 17:
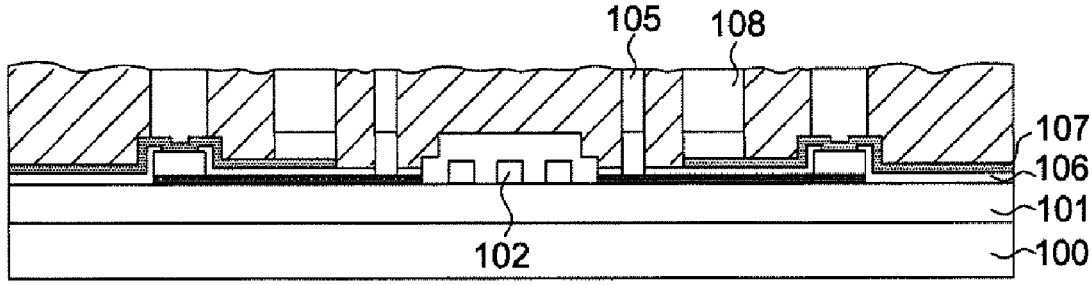

Step 8, FIG. 17. Localized refilling with gold, by prior deposition of photoresist over the whole surface and by injection of current via the bump contacts and the connection lines. The height of gold thus obtained is controlled by the thickness of photoresist. In practice, the thickness (or the height) of gold for the signal lines and for the pillars reaches 3 microns. The photoresist allows the same level to be attained everywhere, which guarantees the planarity of the membrane formed in the following step.

Figure 18A:
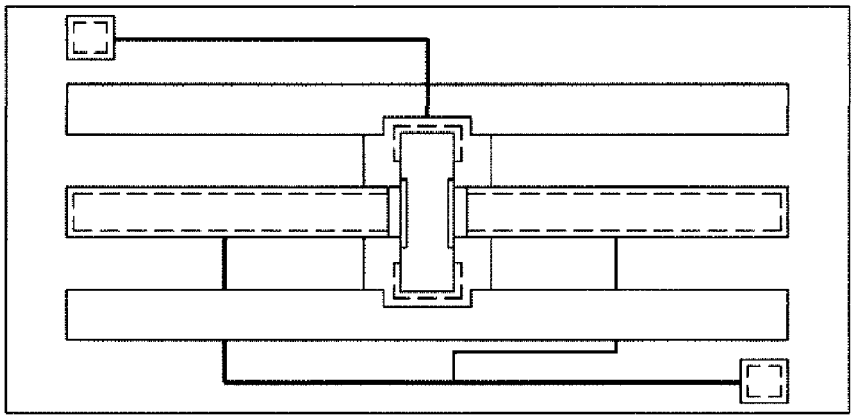
Figure 18B:
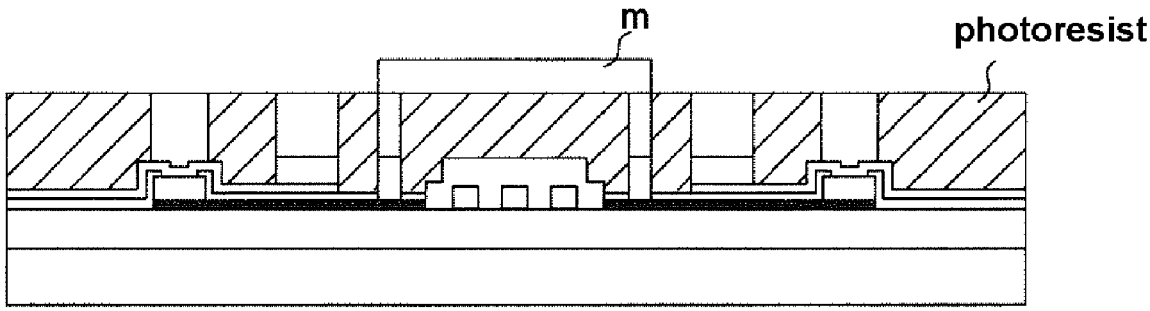

Step 9, FIGS. 18*a* and 18*b*. Formation of the membrane. For a micro-switch used as a switch as in the circulator and as described with reference to FIGS. 3*a* to 3*c*, deposition of titanium-tungsten then deposition of aluminum (or gold, or copper), and etch of the membrane. Preferably, the thickness of titanium-tungsten is equal to 0.2 microns and the thickness of gold is equal to 0.5 microns. For a micro-switch used as a variable capacitor, as in the impedance matching circuit, deposition of a single layer of aluminum with a thickness of around 2.5 microns, and etch.

Figure 19:
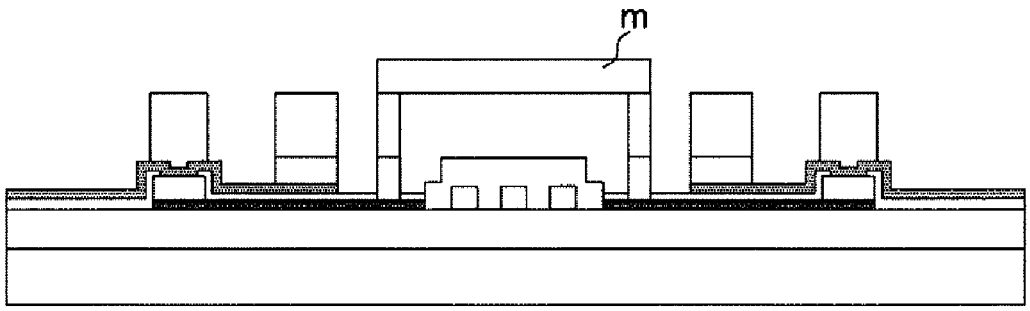

Step 10, FIG. 19: liberation of the membrane by elimination of the layer of photoresist from step 8, for example by solvents. This operation is facilitated by a membrane filled with holes. Such a membrane structure furthermore has the effect of making the membrane less rigid, which contributes to improving the latency and offers enhanced radiofrequency and microwave performance.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only definition contained in the appended claims and equivalents thereof.

The invention claimed is:

1. A circulator, comprising:

at least three ports including a port designed to be connected to a transmitting/receiving antenna, an input port for receiving a radiofrequency or microwave signal to be transmitted to the port, an output port configured to be connected to a receiving device or a load, wherein said circulator further comprises two identical electromechanical micro-switches of the series type formed on a same substrate, and including a first micro-switch being disposed in order to allow the transmission of the radiofrequency or microwave signal from said input port corresponding to a first signal line of said first micro-switch to the port designed to be connected to the antenna, corresponding to a second signal line of said first micro-switch, a second micro-switch being disposed in order to allow the signal transmission between the port designed to be connected to the antenna, corresponding to the first signal line of said second micro-switch, and said output port corresponding to the second signal line of said second micro-switch, and an impedance matching circuit connected to said port designed to be connected to the antenna, said matching circuit having a function of virtual obstacle to the transmission or a reflection of the radiofrequency or microwave signal from said port to the input port, wherein each of the first and second micro-switches is formed on a substrate coated with a passivation layer, wherein:

a mobile metal membrane forming a bridge over a switching region between the first signal line and the second signal line isolated from the first line, the first and second signal lines disposed within the projected extension of one another, said mobile metal membrane comprising at least one layer of a metal selected from Al, Au or Cu, a voltage control electrode formed on the passivation layer, within said switching region, and comprising two electrically isolated parts, a dielectric material of high relative permittivity greater than one hundred, and invariant with frequency, disposed in direct contact on top of said control electrode, and having a shape such that in a direction of the first and second signal lines, said control electrode is wider on either side, and in an orthogonal direction, the dielectric material protrudes on either side from said control electrode, and comes into contact with said passivation layer.

2. The circulator as claimed in claim 1, further comprising at least a first and a second bump contact for applying control voltages at the on or off state to at least one of the parts of the control electrode of the first micro-switch and of the second micro-switch, and said control voltages being of the order of one volt to a few tens of volts, said micro-switches being able to be simultaneously commanded to turn off, or one to turn on and the other to turn off.

3. The circulator as claimed in claim 2, wherein for each of the first and second micro-switches, said mobile metal membrane rests at one end, at least, on a conducting pillar, said conducting pillar and the first and second signal lines being formed on said passivation layer.

4. The circulator as claimed in claim 3, wherein for each of the first and second micro-switches, the first and second signal lines, the contacting pillar and the bump contacts comprise a first resistive conducting layer, in titanium-tungsten, with a proportion of 80/20 to within 1 or 2%.

5. The circulator as claimed in claim 1, for each of the first and second micro-switches, further comprising two parallel coplanar ground lines, disposed symmetrically with respect to said first and second signal lines, said two parallel coplanar ground lines being separated from said first and second signal lines by an insulating layer formed from a material different from that of the passivation layer of the substrate.

6. The circulator as claimed in claim 1, wherein for each of the first and second micro-switches, said control electrode is a platinum/gold alloy.

7. The circulator as claimed in claim 1, wherein said impedance matching circuit comprises a first and a second cell of the LC type, the elements of said cells being calculated as a function of the characteristics of the antenna.

8. The circulator as claimed in claim 1, wherein for each of the first and second micro-switches, a gap region between the two parts of the control electrode has a length of ten micrometers.

9. The circulator as claimed in claim 1, wherein for each of the first and second micro-switches, said mobile metal membrane comprises a lower layer, facing the control electrode, in titanium tungsten, with a proportion of 80/20 and a thickness less than that of said at least one layer of a metal selected from Al, Au or Cu.

10. The circulator as claimed in claim 1, wherein for each of the first and second micro-switches, said at least one layer of a metal selected from Al, Au or Cu of said mobile metal membrane has a thickness of around 0.5 microns, and the membrane has a total thickness of around 0.7 microns.

11. The circulator as claimed in claim 1, wherein said impedance matching circuit is formed by two micro-switches of the series type formed on the same substrate, each being disposed between two sections of a signal line which is designed to be connected at one end to said port of the circulator designed to receive the antenna, and at another end, to be connected to the antenna, wherein each of the two micro-switches has a variable capacitor with a capacitance being defined by the voltage applied to a respective control electrode and the geometric characteristics of the mobile metal membrane, an inductance being defined by the geometric dimensions of a corresponding section of signal line.

12. The circulator as claimed in claim 11, wherein each of the two micro-switches of the impedance matching circuit has a same structure as the first and second micro-switches of the circulator, and each of the mobile metal membranes is formed from a single layer of aluminum of minimum thickness of around 2.5 microns.

13. The circulator as claimed in claim 12, wherein said impedance matching circuit comprises an additional micro-switch used as a variable capacitor, in order to control the control electrodes of the variable capacitors of the two micro-switches of the impedance matching circuit, the control electrode of the variable capacitor being connected to a bump contact of the circuit designed to be connected to the antenna.

14. The circulator as claimed in claim 12, wherein each of the two micro-switches of the impedance matching circuit is formed using microstrip technology, with a ground plane on the back side of the substrate.

15. A radiofrequency telecommunications system comprising a transmitting/receiving antenna, a transmission circuit with amplifier, a receiver circuit with an amplifier and a circulator as claimed in claim 1 with a first port as the input port, connected to the output of the transmission circuit, a second port as the port connected to the antenna, a third port as the output port connected to the receiver circuit.

16. The radiofrequency telecommunications system as claimed in claim 15, further comprising a circulator-isolator disposed between the output of the transmission circuit and the first port of said circulator.

* * * * *